US007214110B1

(12) United States Patent
Ehlers et al.

(10) Patent No.: US 7,214,110 B1
(45) Date of Patent: May 8, 2007

(54) ACCELERATION CONTROL SYSTEM FOR A MARINE VESSEL

(75) Inventors: Jeffery C. Ehlers, Neenah, WI (US); Michael J. Lemancik, Oshkosh, WI (US); James M. Horak, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 23 days.

(21) Appl. No.: 11/245,370

(22) Filed: Oct. 6, 2005

(51) Int. Cl.
*B63H 21/22* (2006.01)

(52) U.S. Cl. ..... 440/1; 440/84

(58) Field of Classification Search ..... 701/110; 440/1, 84

See application file for complete search history.

(56) References Cited

U.S. PATENT DOCUMENTS 5,074,810 A 12/1991 Hobbs et al. ..... 440/2
5,110,310 A 5/1992 Hobbs ..... 440/1
5,700,171 A 12/1997 Horton ..... 440/87
5,884,213 A * 3/1999 Carlson ..... 701/206
6,109,986 A 8/2000 Gaynor et al. ..... 440/87
6,317,678 B1 * 11/2001 Linden ..... 701/94
6,485,341 B1 11/2002 Lanyi et al. ..... 440/87
6,738,708 B2 5/2004 Suzuki et al. ..... 701/110
6,757,606 B1 * 6/2004 Gonring ..... 701/103
6,855,020 B2 2/2005 Kaji ..... 440/84
6,885,919 B1 * 4/2005 Wyant et al. ..... 701/21

* cited by examiner

*Primary Examiner*—Stephen Avila
(74) *Attorney, Agent, or Firm*—William D. Lanyi

(57) ABSTRACT

An acceleration control system is provided which allows the operator of a marine vessel to select an acceleration profile to control the engine speed of a marine vessel from an initial starting speed to a final desired speed. When used in conjunction with tow sports, such as wake boarding and water skiing, the use of acceleration profile provides consistent performance during the period of time when a water skier is accelerated from a stationary position to a full speed condition.

20 Claims, 3 Drawing Sheets

| LEVEL | RATE (Δ% DEMAND/SEC) | % OVERSHOOT | DURATION (SECONDS) |
|---|---|---|---|
| 1 | 9.5 | 0 | 0 |
| 2 | 15 | 5 | 2.5 |
| 3 | 45 | 10 | 3.0 |
| 4 | 95 | 15 | 3.5 |
| 5 | 200 | 20 | 4.0 |

ACCELERATION CONTROL SYSTEM FOR A MARINE VESSEL

BACKGROUND OF THE INVENTION

1. Field of the Invention

The present invention is generally related to an acceleration control system and, more particularly, to a system which allows the operator of a marine vessel to select an acceleration profile according to which the propulsion system of the marine vessel will be controlled, particularly during initial acceleration from a stationary condition to a final velocity.

2. Description of the Related Art

Many different devices and methods are known to those skilled in the art for controlling the speed of a marine vessel.

U.S. Pat. No. 5,074,810, which issued to Hobbs et al. on Dec. 24, 1991, describes an automatic speed control system for boats. The speed of the boat is measured and compared to a desired speed set by the operator and the speed of the boat engine is adjusted to minimize the difference between the desired speed and the actual speed. The device further incorporates features allowing incremental adjustment of the desired speed, storage of several of these speeds for future use, and a safety feature causing the system to behave as though it were a conventional manual type if the operator makes a gross change to the setting of a manual throttle lever.

U.S. Pat. No. 5,110,310, which issued to Hobbs on May 5, 1992, describes an automatic speed control system for boats. Actual speed is compared to a desired speed set by the operator and the speed of the boat engine is adjusted to minimize the difference between the desired speed and the actual speed. Engine speed is further adjusted to prevent or minimize changes in the speed of the boat caused by the forces on the boat due to a water skier. The device further incorporates features to reduce the likelihood of speed measurement errors due to a malfunctioning speed measuring device.

U.S. Pat. No. 5,700,171, which issued to Horton on Dec. 23, 1997, describes a speed control system. It comprises speed sensors which output to a controller which, in turn, outputs to a servo motor. The servo is connected to the inner cable of a coaxial cable, the outer sheath of which is lodged between a buttress and the engine throttle. The distance between the buttress and the engine throttle lever is, at least when the throttle is closed, shorter than the length of the outer sheath such that the outer sheath obtains a curved configuration. The inner cable extends beyond the engine throttle lever to a support. Accordingly, when the controller operates the servo to draw in the inner cable, the outer sheath is urged to straighten and, thereby, push against the engine throttle lever to open it. Conversely, when the inner cable is paid out, the outer sheath is relaxed to allow the engine throttle lever to close.

U.S. Pat. No. 6,109,986, which issued to Gaynor et al. on Aug. 29, 2000, discloses an idle speed control system for a marine propulsion system. The system controls the amount of fuel injected into the combustion chamber of an engine cylinder as a function of the error between a selected target speed and an actual speed. The speed can be engine speed measured in revolutions per minute or, alternatively, it can be boat speed measured in nautical miles per hour or kilometers per hour. By comparing target speed to actual speed, the control system selects an appropriate pulse width length for the injection of fuel into the combustion chamber and regulates the speed by increasing or decreasing the pulse width.

U.S. Pat. No. 6,485,341, which issued to Lanyi et al. on Nov. 26, 2002, discloses a method for controlling the average speed of a vehicle. The speed of the vehicle is controlled over a predetermined time period, or indefinitely, or distance length. The system comprises the steps of selecting a desired average speed, measuring an actual speed, and maintaining a cumulative error determined as a function of the difference between the average speed and the actual speed and the time over which the actual speed measurement was taken. Based on the cumulative total or speed time error, a compensatory speed is calculated that will reduce the cumulative speed time error to an acceptable tolerance range within a selected period of elapsed time. Although particularly applicable to competition situations in which an average speed is dictated for use over a particular competition course, the average speed controlling method can be used in other situations where the average speed of a vehicle must be controlled.

U.S. Pat. No. 6,738,708, which issued to Suzuki et al. on May 18, 2004, describes an engine speed controller for a marine propulsion engine. An electronically controlled engine speed system for an outboard motor regulates the speed of the engine to insure proper watercraft speed. A remote input device can program the preferred embodiments of the system. The preferred embodiments of the system recognize an engaged transmission and control engine speed by changing the ignition timing, fuel injection amount, and throttle bypass valve.

U.S. Pat. No. 6,855,020, which issued to Kaji on Feb. 15, 2005, describes a running control device for a watercraft. The device for a watercraft with a propulsion device capable of controlling propulsion, comprises a propulsion control section which controls propulsion, based on predetermined input information, the propulsion control section comprises a target propulsion calculation module for determining a target propulsion, based on predetermined input information including at least velocity of the watercraft and an operation amount calculation module for determining the amount of operation of the propulsion device, based on predetermined input information so as to obtain the target propulsion determined by the propulsion calculation module.

The patents described above are hereby expressly incorporated by reference in the description of the present invention.

In certain applications of marine vessels, such as towing a water skier or wake boarder, the rate of acceleration from a standstill position to a final velocity condition is often as important or more important than maintaining a steady velocity for the water skier. If the acceleration is too rapid, novice or intermediate water skiers may not be able to satisfactorily move from a resting position to a water skiing position wherein the skier is being towed at a final velocity behind the marine vessel. An expert water skier, on the other hand, may wish to accelerate more rapidly from a resting position in the water to a position and condition in which the water skier is being pulled at a final velocity behind the marine vessel.

It would therefore be significantly beneficial if the acceleration of the watercraft can be controlled precisely to perform according to a preselected acceleration curve and repeat that curve during subsequent accelerations of the marine vessel from a resting condition to a final velocity condition.

SUMMARY OF THE INVENTION

An acceleration control method for an engine of a marine vessel, in accordance with a preferred embodiment of the present invention, comprises the steps of receiving a start command, selecting an acceleration profile, and controlling the speed of the engine according to the selected acceleration profile. The acceleration profile can comprise a first segment associated with a first period of time and a second segment associated with a second period of time. The first segment of the acceleration profile extends from an initial engine speed to a speed which is generally equal to a desired final speed. The second segment of the acceleration profile extends from the desired engine speed, at the end of the first period of time, to a speed which is greater than the desired final speed by a preselected magnitude and then to the desired engine speed at the end of the second period of time. The second segment can comprise an acceleration portion and a deceleration portion which both occur during the second period of time. The start command can be caused by a sudden movement of a manually operated throttle handle. When the manually operated throttle handle is suddenly moved from a first position to a second position at a rate of movement which exceeds a preselected magnitude, this action can be interpreted as the start command by the present invention.

The acceleration during the first segment can be generally constant. The method of the present invention, in a preferred embodiment, can further comprise the step of receiving a signal representing a selection of the acceleration profile from a plurality of potential acceleration profiles. This signal can typically be provided by the operator of the marine vessel as the operator makes the selection from the plurality of potential acceleration profiles.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
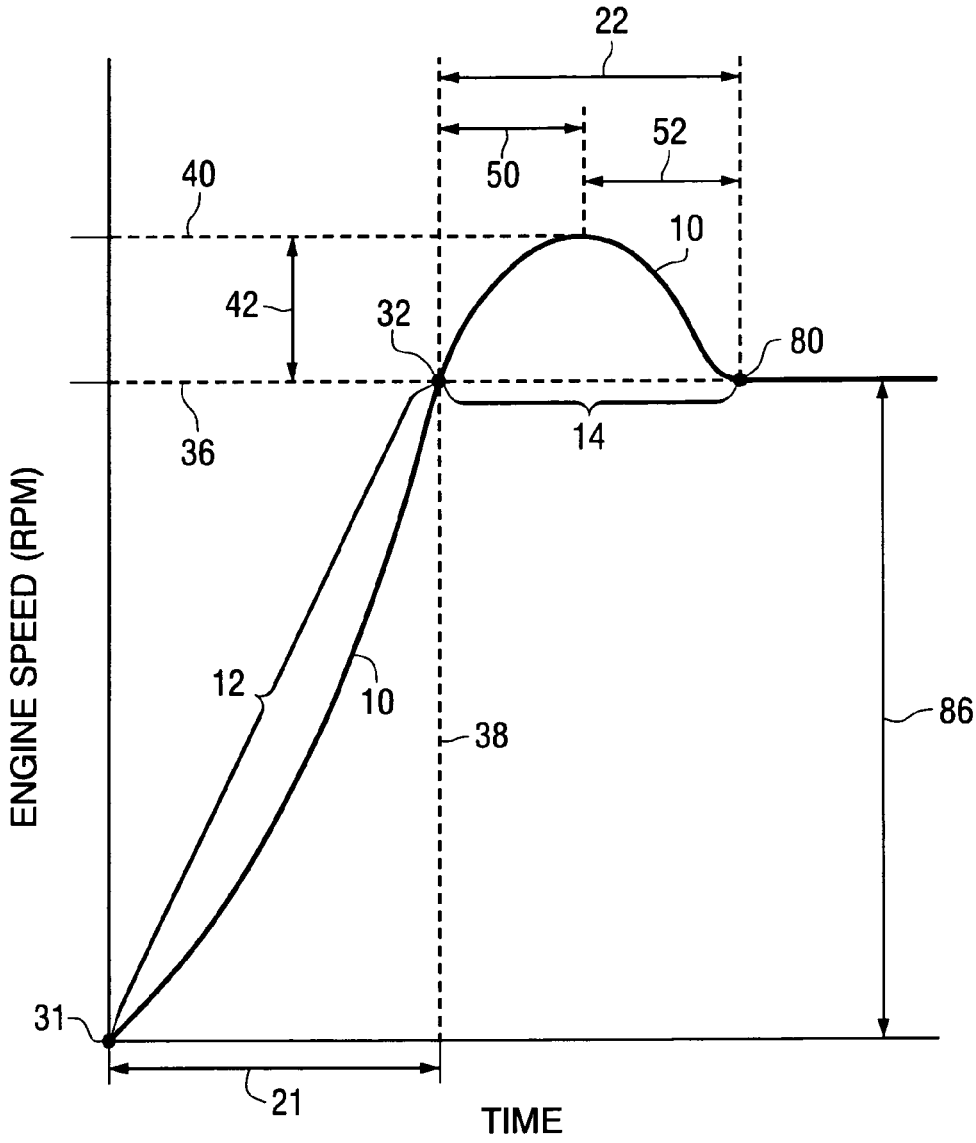
FIG. 1 is a graphical representation of an exemplary acceleration profile.

Throughout the description of the preferred embodiment of the present invention, like components will be identified by like reference numerals.

FIG. 1 is a graphical representation of an exemplary acceleration profile 10 for a marine vessel. The acceleration profile 10, illustrated as engine speed as a function of time, comprises a first segment 12 and a second segment 14. The first segment 12 is associated with a first period of time 21 and the second segment 14 is associated with a second period of time 22. The first segment 12 of the acceleration profile 10 extends from an initial engine speed 31 to an engine speed 32 which is generally equal to a desired engine speed, or final engine speed, which is represented by dashed line 36. The second segment 14 of the acceleration profile 10 extends from that desired engine speed, at point 32, which occurs at the end of the first period of time 21 represented by dashed line 38, to a speed which is somewhat greater than the desired final speed 36. This greater engine speed is identified by dashed line 40 in FIG. 1. The greater speed 40 is of a greater magnitude than the desired final engine speed 36 by a preselected magnitude which is illustrated by arrow 42.

With continued reference to FIG. 1, it can be seen that the second segment 14 can comprise an acceleration portion, during the time period identified by arrow 50, and a deceleration portion during the time period represented by arrow 52. Both the acceleration portion and the deceleration portion occur during the second period of time 22 in a preferred embodiment of the present invention.

Figure 2:
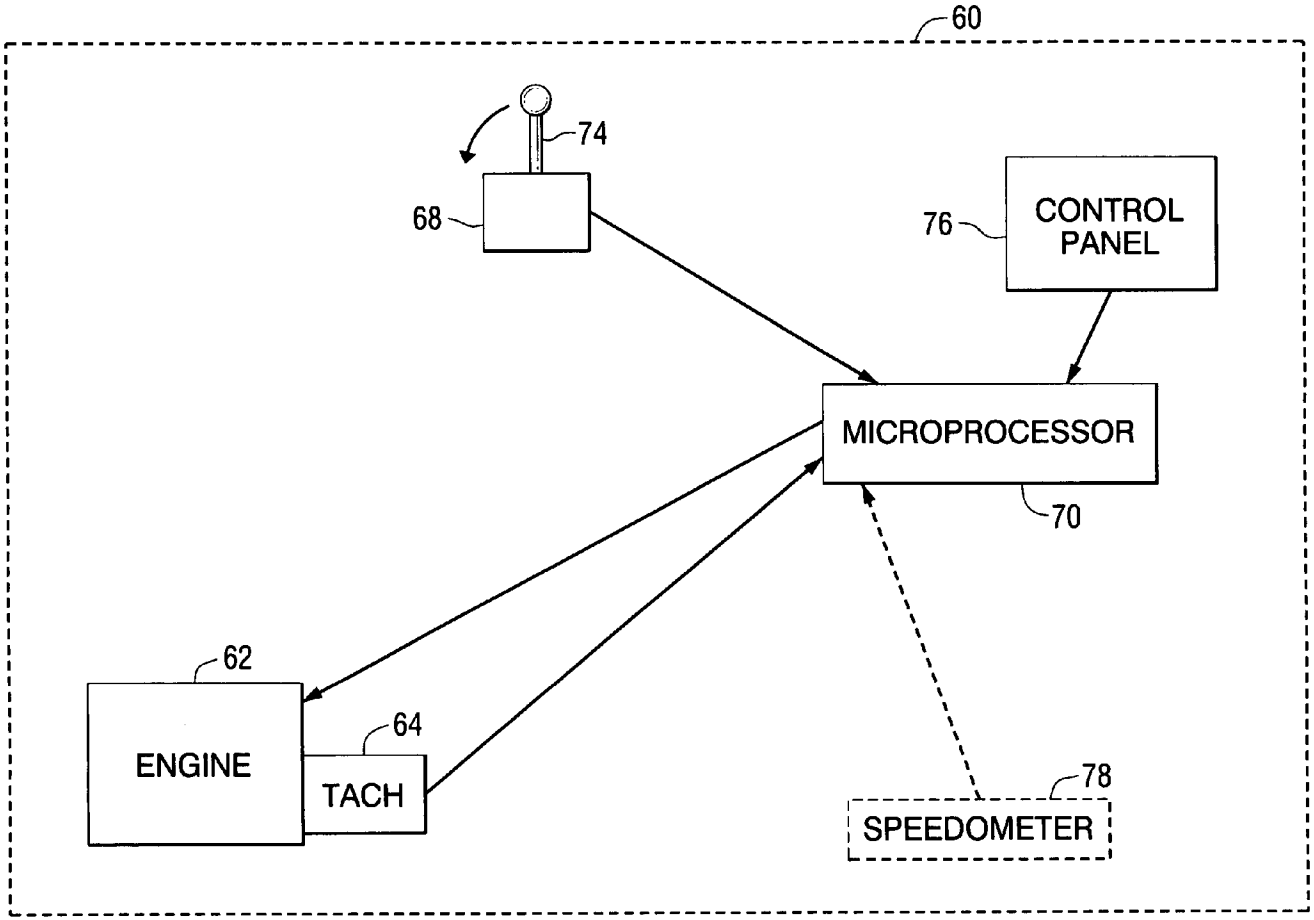
FIG. 2 is a schematic representation of a marine vessel with the various components used to perform the method of the present invention.

FIG. 2 is a schematic representation of the environment in which a preferred embodiment of the present invention can typically be used. Dashed line box 60 represents the environment of a marine vessel in which an engine 62, with a tachometer 64, provides marine propulsion for the vessel. A manually controllable throttle mechanism 68 allows the operator of the marine vessel to control the operating speed of the engine 62. A microprocessor 70, such as an engine control module, controls the operating speed of the engine 62 in conformance with signals received from the position of a throttle handle 74 of the manually controlled throttle mechanism. Also shown in FIG. 2 is a control panel 76 which allows the operator of the marine vessel, in certain embodiments of the present invention, to provide additional information to the microprocessor 70. Shown in dashed lines in FIG. 2 is a speedometer 78 which provides signals to the microprocessor 70 in certain embodiments of the present invention. However, it should be understood that the speedometer 78 is not required in all embodiments of the present invention and that a GPS device is also an alternative if velocity measurement is desired.

With reference to FIGS. 1 and 2, a start command is received by the microprocessor 70 from the manually operated throttle mechanism 68 in a preferred embodiment of the present invention. This can be the sudden movement of the throttle handle 74, as indicated by the arrow, from a neutral position or idle speed position to a higher speed command with a relatively sudden movement of the handle 74. The control panel 76 allows the operator of the marine vessel to select an acceleration profile, typically from a portfolio of potential profiles, and provide that selection to the microprocessor 70 for future application when a start command signal is received.

With continued reference to FIGS. 1 and 2, several characteristics of a preferred embodiment of the present invention can be observed. For example, the first segment 12, of the acceleration profile 10, during the first time period 21, is generally constant. The graphical representation in FIG. 1 shows this first segment as representing a slightly increasing acceleration rate as the engine speed changes from point 31 to point 32. However, this acceleration rate can be much more constant than is shown in FIG. 1. In other words, the first segment of the acceleration profile can be virtually a straight line extending between points 31 and 32. After the expiration of the first period of time 21, an overshoot condition is intentionally provided in a preferred embodiment of the present invention. After achieving the desired final engine speed 36, at point 32, the engine speed is increased beyond that desired engine speed 36 to achieve the overshoot represented by arrow 42. This results in the achievement of the speed represented by dashed line 40. This continued acceleration occurs in the time period identified by arrow 50. Then, according to a preselected procedure, the engine speed is decelerated during time period 52 to the desired final engine speed which is achieved at point 80 in FIG. 1.

Figures 3, 4:
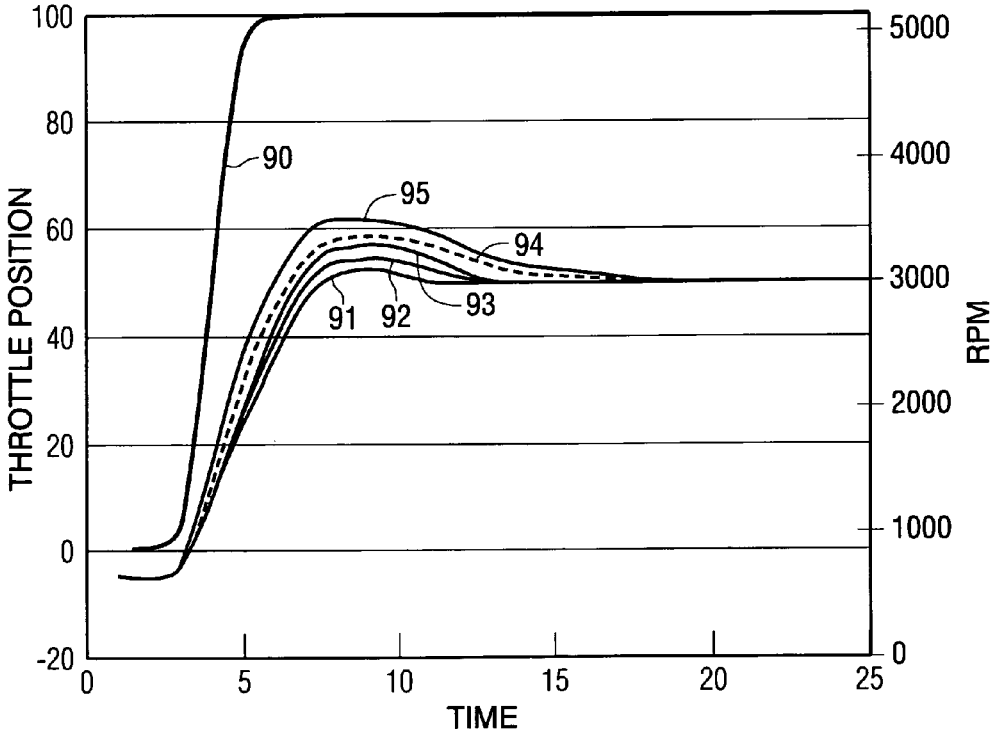
FIG. 3 is a table showing the parameters used to describe various acceleration profiles.
FIG. 4 is a graphical representation of the rate of movement of a throttle handle in combination with five acceleration profiles.

The information relating to the acceleration profile, in a particularly preferred embodiment of the present invention, is represented by three parameters for each of five potential acceleration profiles. The information is shown in FIG. 3. In this exemplary table of FIG. 3, five skill levels are represented. For each level, the rate of acceleration, represented as Δ Demand/sec or Δ Thrust/sec, is stored along with an associated percentage overshoot magnitude. The percentage overshoot magnitude is equivalent to the percentage of the magnitude represented by arrow 42 in FIG. 1 to the magnitude represented by arrow 86 in FIG. 1. If the final desired speed is 3400 RPM, for example, the level three illustration in FIG. 3 would describe a 10% overshoot, or 340 RPM for three seconds, which would be the difference represented by arrow 42 in FIG. 1. In FIG. 3, the duration for each level is also stored. This duration represents the magnitude of arrow 21, measured in seconds, for each of the skill levels. The operator of the marine vessel would select a skill level (e.g. 1–5) prior to providing the next start signal which occurs when the operator rapidly moves the manually operated throttle handle 74 from an initial speed position to a higher speed position.

FIG. 4 is a graphical representation of several characteristics. Line 90 represents the throttle position, or position of the handle 74, represented by the left axis as percentage of the maximum engine speed command. In addition, five acceleration profiles are shown with respect to the right axis in FIG. 4.

As shown in FIG. 4, this particular embodiment of the present invention responds to a rapid movement of the throttle handle 74, as represented by line 90, from a zero speed command to a demand greater than the demand, or thrust, needed to achieve the set point throttle command in a relatively short period of time. When this rapid movement of the handle 74 is detected by the microprocessor 70, one of the illustrated acceleration profiles is followed. It should be understood that, although five profiles are shown simultaneously in FIG. 4, only one profile would be applied. That acceleration profile would typically have been previously selected from a choice of potential acceleration profiles by the operator of the marine vessel. In FIG. 4, acceleration profile 91 conforms generally with the level one profile in FIG. 3, acceleration profile 92 in FIG. 4 conforms generally with the second level shown in FIG. 3, and so on.

With reference to FIGS. 1–4, it should be understood that the use of a marine vessel to tow a skier can be significantly aided by the preferred embodiment of the present invention which provides consistency during the initial acceleration from a standing position to a final desired boat speed. In the tow sports, such as wake boarding and water skiing, a high degree of precision is often required on the part of both the water skier and the operator of the marine vessel. Cruise control systems, such as those discussed above, are generally known to those skilled in the art and have provided significant help in these endeavors. While known cruise control systems address the steady state, or final desired speed issues for providing the predetermined boat speed, one of the remaining challenges for most tow sports, is the challenge of achieving repeatability and control in the process of "getting up" from a stationary position in the water to a position wherein the water skier is in a standing position and moving at the desired final speed of the marine vessel. Significant variation can occur in the engine torque needed to bring a skier from a stationary position in the water to an "on plane" condition. This engine torque can vary from approximately fifty foot pounds to approximately three hundred fifty foot pounds, depending on the weight of the skier. Repeatability in the acceleration profile during the beginning of the process is significantly important.

By using the preferred embodiment of the present invention, the operator of a marine vessel is able to select the skier's target speed and acceleration profile. The acceleration profiles, as described above, could vary from a relatively delicate starting process to a more aggressive starting process, wherein virtually the full power of the engine can be applied very rapidly.

In a preferred embodiment of the present invention, the acceleration profile comprises the initial acceleration portion, or first segment, and an overshoot portion, or second segment. The overshoot portion is perceived by the water skier as a more robust or aggressive start from a stationary position to an "on plane" position. This is a result of the vessel speed lagging the engine speed.

Seen in FIG. 4, all five levels, 91–95, begin at the same initial engine speed and end at the same final engine speed, but vary significantly in the acceleration rate of the first segment and the overshoot of the second segment.

The processes by which the microprocessor 70 shown in FIG. 2 controls the operating speed of the engine 62 can vary from application to application and according to the various embodiments of the present invention. In a typical application, during the first segment of the acceleration profile and subsequent to a start command, the microprocessor 40 would repeatedly schedule the maximum demand, or thrust, ramp by increasing the opening of the throttle plate of the engine 62. Adjustments, to increase the rate of throttle plate movement or decrease the rate of throttle plate movement, would be made as a function of the launch intensity level. This limiting function would continuously be performed during the first segment of the acceleration profile. Then, after determining the desired percentage of overshoot for the second segment of the acceleration profile, the microprocessor would perform a generally similar function in order to achieve the desired shape of the acceleration profile, as discussed above in conjunction with FIG. 1. Alternatively, the microprocessor of the engine control module could vary the fuel injected into the cylinders of the engine, such as in a direct fuel injected engine, to achieve the desired demand at each instant during the time period of the acceleration profile. It should be understood that those skilled in the art of engine control have many alternative processes that are well known for controlling the engine speed at any particular instant in time. These processes can be performed at each instant in time over the time period of the acceleration profile to achieve the desired profile.

Although the present invention has been described in considerable detail and illustrated to show a preferred embodiment, it should be understood that alternative embodiments are also within its scope.

We claim:

1. An acceleration control method for an engine of a marine vessel, comprising the steps of:

receiving a start command;

selecting an acceleration profile of engine speed as a function of time; and controlling the output thrust of said engine, during a period of time subsequent to receipt of said start command, according to said acceleration profile.

2. The method of claim 1, wherein:

said acceleration profile comprises a first segment associated with a first period of time and a second segment associated with a second period of time.

3. The method of claim 2, wherein:

said first segment of said acceleration profile extends from an initial engine speed to a speed which is generally equal to a desired engine speed.

4. The method of claim 3, wherein:

said second segment of said acceleration profile extends from said desired engine speed, at the end of said first period of time, to a speed which is greater than said desired engine speed by a preselected magnitude and then to said desired engine speed at the end of said second period of time.

5. The method of claim 4, wherein:

said second segment comprises an acceleration portion and a deceleration portion which both occur during said second period of time.

6. The method of claim 1, wherein:

said start command is caused by a movement of a manually operated throttle handle.

7. The method of claim 6, wherein:

said start command is caused by a movement of a manually operated throttle handle from a first position to a second position at a rate of movement which exceeds a preselected magnitude.

8. The method of claim 2, wherein:

an acceleration during said first segment is generally constant.

9. The method of claim 1, further comprising:

receiving a signal representing a selection of said acceleration profile from a plurality of potential acceleration profiles.

10. An acceleration control method for an engine of a marine vessel, comprising the steps of:

receiving a signal representing a selection of an acceleration profile from a plurality of potential acceleration profiles;

receiving a start command;

selecting said acceleration profile, of engine speed as a function of time, as a function of said signal representing said selection; and controlling the output thrust of said engine, during a period of time subsequent to receipt of said start command, according to said acceleration profile.

11. The method of claim 10, wherein:

said acceleration profile comprises a first segment associated with a first period of time and a second segment associated with a second period of time.

12. The method of claim 11, wherein:

said first segment of said acceleration profile extends from an initial engine speed to a speed which is generally equal to a desired engine speed.

13. The method of claim 12, wherein:

said second segment of said acceleration profile extends from said desired engine speed, at the end of said first period of time, to a speed which is greater than said desired engine speed by a preselected magnitude and then to said desired engine speed at the end of said second period of time.

14. The method of claim 13, wherein:

said second segment comprises an acceleration portion and a deceleration portion which both occur during said second period of time.

15. The method of claim 14, wherein:

said start command is caused by a movement of a manually operated throttle handle.

16. The method of claim 15, wherein:

said start command is caused by a movement of a manually operated throttle handle from a first position to a second position at a rate of movement which exceeds a preselected magnitude.

17. The method of claim 16, wherein:

an acceleration during said first segment is generally constant.

18. An acceleration control method for an engine of a marine vessel, comprising the steps of:

receiving a signal representing a selection of an acceleration profile from a plurality of potential acceleration profiles;

receiving a start command;

selecting said acceleration profile as a function of said signal representing said selection, said acceleration profile comprising a first segment associated with a first period of time and a second segment associated with a second period of time, said first segment of said acceleration profile extending from an initial engine speed to a speed which is generally equal to a desired engine speed, said second segment of said acceleration profile extending from said desired engine speed, at the end of said first period of time, to a speed which is greater than said desired engine speed by a preselected magnitude and then to said desired engine speed at the end of said second period of time; and controlling the output thrust of said engine according to said acceleration profile.

19. The method of claim 18, wherein:

said second segment comprises an acceleration portion and a deceleration portion which both occur during said second period of time.

20. The method of claim 19, wherein:

said start command is caused by a movement of a manually operated throttle handle from a first position to a second position at a rate of movement which exceeds a preselected magnitude.

* * * * *